US009989879B2

(12) United States Patent
Doi et al.

(10) Patent No.: US 9,989,879 B2
(45) Date of Patent: Jun. 5, 2018

(54) CHARGING MEMBER, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Noriyuki Doi, Numazu (JP); Masataka Kodama, Mishima (JP); Kineo Takeno, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 124 days.

(21) Appl. No.: 15/186,725

(22) Filed: Jun. 20, 2016

(65) Prior Publication Data

US 2016/0378010 A1 Dec. 29, 2016

(30) Foreign Application Priority Data

Jun. 26, 2015 (JP) ..... 2015-129031

(51) Int. Cl.
*G03G 15/02* (2006.01)
*G03G 21/18* (2006.01)

(52) U.S. Cl.
CPC ..... *G03G 15/0233* (2013.01); *G03G 21/1814* (2013.01)

(58) Field of Classification Search
CPC ..... G03G 15/0233
USPC ..... 399/176
See application file for complete search history.

(56) References Cited

U.S. PATENT DOCUMENTS

| | | | |
|---|---|---|---|
| 8,383,234 | B2 | 2/2013 | Mayuzumi et al. |
| 8,503,911 | B2 | 8/2013 | Suzumura et al. |
| 8,526,857 | B2 | 9/2013 | Tomomizu et al. |
| 8,548,359 | B2 | 10/2013 | Taniguchi et al. |
| 2013/0004206 | A1 | 1/2013 | Kuroda et al. |
| 2013/0034369 | A1 | 2/2013 | Masu et al. |
| 2013/0064571 | A1 | 3/2013 | Kodama et al. |
| 2014/0004258 | A1 | 1/2014 | Suzumura et al. |
| 2014/0072343 | A1 | 3/2014 | Masu et al. |
| 2014/0080691 | A1 | 3/2014 | Kurachi et al. |
| 2015/0331348 | A1 | 11/2015 | Doi et al. |
| 2016/0161877 | A1 | 6/2016 | Masu et al. |

FOREIGN PATENT DOCUMENTS

| | | |
|---|---|---|
| JP | 2001-173641 | 6/2001 |
| WO | 2015/098117 | 7/2015 |

*Primary Examiner* — Ramsey E Zacharia
(74) *Attorney, Agent, or Firm* — Fitzpatrick Cella Harper and Scinto

(57) ABSTRACT

A charging member is provided which can prevent electrostatic adhesion of a toner and/or an external additive of the toner to the surface of the charging member, and exhibits stable charging performance during long-term use. The charging member comprises a support, and a surface layer on the support, and the surface layer comprises a polymetalloxane containing at least one metal atom selected from the group consisting of aluminum, titanium, zirconium and tantalum, and a specific group which is bonded to the at least one metal atom in the polymetalloxane.

6 Claims, 4 Drawing Sheets

CHARGING MEMBER, PROCESS CARTRIDGE AND ELECTROPHOTOGRAPHIC IMAGE FORMING APPARATUS

BACKGROUND OF THE INVENTION

Field of the Invention

The present disclosure relates to a charging member, and a process cartridge and an electrophotographic image forming apparatus, hereinafter, also referred to as "electrophotographic apparatus", including the charging member.

Description of the Related Art

One of methods of charging the surfaces of electrophotographic photosensitive members, hereinafter, also referred to as "photosensitive members", is a contact electrical discharge process. In the contact electrical discharge process, voltage is applied to a charging member disposed on the photosensitive member to be in contact therewith and very small discharge is generated near the contact portion between the charging member and the photosensitive member to charge the surface of the photosensitive member.

A typical configuration of the charging member used in the contact electrical discharge process includes an electro-conductive elastic layer to sufficiently ensure the contact nip between the charging member and the photosensitive member. Unfortunately, the electro-conductive elastic layer often contains a relatively large amount of low molecular weight components. For this reason, these low molecular weight components may bleed to the surface of the charging member, and may adhere to the photosensitive member. To prevent bleed of the low molecular weight components to the surface of the charging member, a surface layer may be disposed on the electro-conductive elastic layer.

Japanese Patent Application Laid-Open No. 2001-173641 discloses an electro-conductive roll provided with an electro-conductive roll substrate containing a resinous material; and an inorganic oxide film as a bleed-preventing layer, which is formed by a sol-gel method, and covers a surface of the electro-conductive roll substrate.

In recent years, a further enhancement in durability has been required for electrophotographic image forming apparatuses. To meet this requirement, a charging member which exhibits stable charging performance for a long time is needed.

SUMMARY OF THE INVENTION

One aspect of the present disclosure is directed to providing a charging member which can prevent electrostatic adhesion of a toner and/or an external additive of the toner to the surface of the charging member, and exhibits stable charging performance during long-term use. Another aspect of the present disclosure is directed to providing a process cartridge and an electrophotographic apparatus which can stably form electrophotographic images with high quality.

According to one aspect of the present disclosure, there is provided a charging member including a support, and a surface layer on the support, wherein the surface layer contains a polymetalloxane containing at least one metal atom selected from the group consisting of aluminum, titanium, zirconium and tantalum, and at least one group selected from groups represented by Formulae (1) to (4) is bonded to the at least one metal atom in the polymetalloxane:

Formula (1)

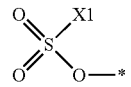

Formula (2)

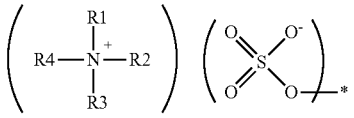

Formula (3)

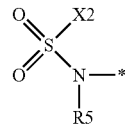

Formula (4)

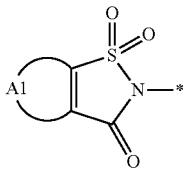

where X1 and X2 each independently represent an alkyl group having 1 to 20 carbon atoms or a substituted or unsubstituted aryl group having 6 to 20 carbon atoms; R1 to R5 each independently represent a hydrogen atom or an alkyl group having 1 to 20 carbon atoms; A1 represents a group of atoms needed to form an aromatic ring; and a symbol "*" represents a site of bonding to the metal atom in the polymetalloxane.

According to another aspect of the present disclosure, there is provided a process cartridge configured to be detachably attachable to the main body of an electrophotographic image forming apparatus, including an electrophotographic photosensitive member, and a charging member disposed such that the surface of the electrophotographic photosensitive member can be charged, wherein the charging member is the above-described charging member.

According to further another aspect of the present disclosure, there is provided an electrophotographic image forming apparatus including an electrophotographic photosensitive member, and a charging member disposed such that the surface of the electrophotographic photosensitive member can be charged, wherein the charging member is the above-described charging member.

Further features of the present disclosure will become apparent from the following description of exemplary embodiments with reference to the attached drawings.

DESCRIPTION OF THE EMBODIMENTS

Preferred embodiments of the present disclosure will now be described in detail in accordance with the accompanying drawings.

The present inventors, who have conducted research, have found that use of the electro-conductive roll according to Japanese Patent Application Laid-Open No. 2001-173641 as a charging member causes adhesion of a toner and/or an external additive of the toners to the surface of the charging member to reduce the charging performance of the charging member.

In an electrophotographic process using a negatively chargeable toner, the toners remaining on the electrophotographic photosensitive member without being transferred onto a recording medium (hereinafter, also referred to as "transfer residual toners") and the external additives of the toners include weakly negatively charged toners or positively charged toners. It is found that these weakly negatively charged toners or positively charged toners and the external additives of the toners are electrostatically attracted to the charging member to adhere to the surface of the charging member, resulting in a reduction in charging performance of the charging member. This phenomenon is particularly remarkable in environments at low temperature and low humidity.

The present inventors have conducted research on the method for preventing contamination of the surface of the charging member using facilitating of electrostatic peel-off of the toner and/or the external additive of the toner from the charging member by negatively charging during friction to the toner and/or the external additive adhering to the surface of the charging member. The present inventors thus have achieved the present invention.

One embodiment according to the present invention will now be described in detail.

<Charging Member>

One embodiment of the charging member according to the present invention will now be described by exemplifying a charging member in the form of a roller (hereinafter, referred to as "charging roller" in some cases). The charging member can have any shape, such as a roller or a plate, without limitation.

Figure 1:
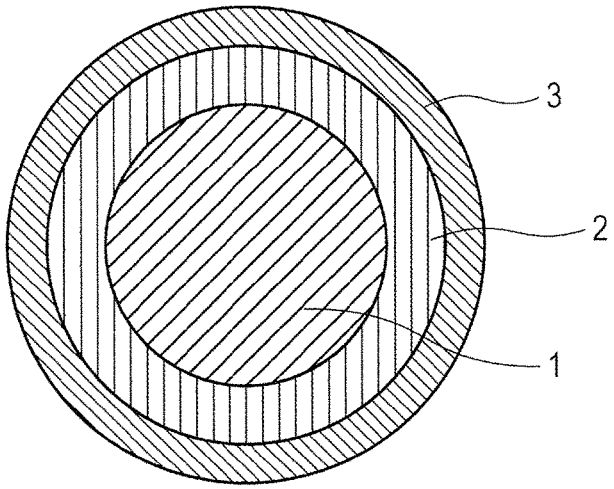
FIG. 1 is a cross-sectional view of an example of the charging member according to the present disclosure.

FIG. 1 is a cross-sectional view illustrating a charging roller including a support 1, and an elastic layer 2 and a surface layer 3 formed on the support 1.

The charging member can have a configuration including an elastic layer from the viewpoint of sufficiently ensuring the contact nip with a photosensitive member. The simplest configuration of the charging member including an elastic layer includes two layers, i.e., an elastic layer and a surface layer disposed on a support. One or two or more other layers may be disposed between the support and the elastic layer or between the elastic layer and the surface layer.

[Surface Layer]

The surface layer 3 contains a polymetalloxane containing at least one metal atom selected from the group consisting of aluminum, titanium, zirconium and tantalum, and at least one group selected from groups represented by Formulae (1) to (4) is bonded to the at least one metal atom in the polymetalloxane:

Formula (1)

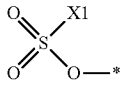

Formula (2)

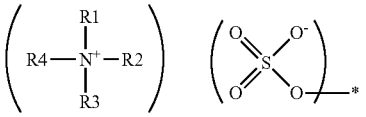

-continued

Formula (3)

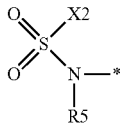

Formula (4)

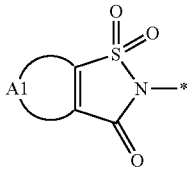

where X1 and X2 each independently represent an alkyl group having 1 to 20 carbon atoms or a substituted or unsubstituted aryl group having 6 to 20 carbon atoms; R1 to R5 each independently represent a hydrogen atom or an alkyl group having 1 to 20 carbon atoms; A1 represents a group of atoms needed to form an aromatic ring; and a symbol "*" represents a site of bonding to the metal atom in the polymetalloxane.

In the polymetalloxane, an organic group having a specific structure is bonded to a metal atom in the polymetalloxane. Due to this, the electronic structure of the metal is changed, and electrons are easy to be emitted. For this reason, it is considered that the toner and/or the external additive of the toner adhering to the surface of the charging member can be negatively charged by emitting of electrons from the surface of the charging member during friction of a toner and an external additive of the toner with the surface of the charging member. The present inventors infer that, as a result of the above negatively charging, the toner and/or the external additive of the toner become easy to be electrostatically peeled off from the charging member, and adhesion of the toner and/or the external additive of the toner to the surface of the charging member can be prevented.

The at least one group selected from the groups represented by Formulae (1) to (4) can be contained in an amount of 0.1 mol or more and 3 mol or less relative to 1 mol of the metal atom (aluminum, titanium, zirconium and tantalum) contained in the polymetalloxane. If the content of the at least one group selected from the groups represented by Formulae (1) to (4) is 0.1 mol or more, adhesion of the toner and/or the external additive of the toner to the surface of the charging member is effectively prevented. If the content of the at least one group selected from the groups represented by Formulae (1) to (4) is 3 mol or less, the surface layer 3 has excellent film properties (smoothness and strength of the film). To further enhance the effect of preventing adhesion of the toner and/or the external additive of the toner to the surface of the charging member, the at least one group selected from the groups represented by Formulae (1) to (4) can be contained in an amount in the range of 1 mol or more and 3 mol or less relative to 1 mol of the metal atom. In particular, when the surface layer contains the group represented by Formula (1) and the group represented by Formula (1) is contained in an amount of 1 mol or more and 3 mol or less relative to 1 mol of the metal atom, a high effect of preventing adhesion of the toner and/or the external additive of the toner to the surface of the charging member is provided.

The structures of the groups represented by Formulae (1) to (4) will now be described in detail.

In Formulae (1) to (4), X1 and X2 each independently represent an alkyl group having 1 to 20 carbon atoms or a substituted or unsubstituted aryl group having 6 to 20 carbon atoms. X1 and X2 can be an alkyl group having 1 to 10 carbon atoms or a substituted or unsubstituted aryl group having 6 to 18 carbon atoms. The alkyl group may be linear, branched or cyclic. Specifically, examples of the alkyl group include a methyl group, an ethyl group, a n-propyl group, an iso-propyl group, a n-butyl group, a sec-butyl group, a t-butyl group, a n-pentyl group, a n-hexyl group, a cyclohexyl group, a n-octyl group, a n-decyl group, a n-dodecyl group, a hexadecyl group and an octadecyl group. Specifically, examples of the aryl group include a phenyl group, a naphthyl group and an anthryl group. The substituent for the aryl group can be an alkyl group having 1 to 10 carbon atoms, an alkoxy group having 1 to 10 carbon atoms, or a phenyl group, particularly an alkyl group having 1 to carbon atoms, an alkoxy group having 1 to 4 carbon atoms, or phenyl group. X1 and X2 can be specifically a methyl group, an ethyl group, a n-propyl group, an iso-propyl group, a n-butyl group, a sec-butyl group, a t-butyl group, a phenyl group, a p-tolyl group, a t-butyl phenyl group, a biphenyl group, a 1-naphthyl group, a 2-naphthyl group, a 1-anthryl group, a 2-anthryl group, or a 9-anthryl group.

In Formulae (1) to (4), R1 to R5 each independently represent a hydrogen atom or an alkyl group having 1 to 20 carbon atoms. The alkyl group can be an alkyl group having 1 to 4 carbon atoms. Specifically, examples of R1 to R5 include a hydrogen atom, a methyl group, an ethyl group, a n-propyl group, an iso-propyl group, a n-butyl group, a sec-butyl group, a t-butyl group, a n-pentyl group, a n-hexyl group, a cyclohexyl group, a n-octyl group, a n-decyl group, a n-dodecyl group, a hexadecyl group and an octadecyl group.

In Formula (4), A1 represents a group of atoms needed to form an aromatic ring. Specifically, A1 is a group of atoms needed to form a substituted or unsubstituted aryl group having 6 to 20 carbon atoms, preferably 6 to 18 carbon atoms. More preferably, A1 represents a group of atoms needed to form a substituted or unsubstituted benzene ring or a substituted or unsubstituted naphthalene ring. The substituent can be an alkyl group having 1 to 10 carbon atoms, particularly 1 to 4 carbon atoms, or an alkoxy group having 1 to 10 carbon atoms, particularly 1 to 4 carbon atoms.

The groups represented by Formulae (1) to (4) can be specifically groups represented by Formulae (1a) to (1e), (2a) and (2b), (3a) to (3e), and (4a) to (4d).

Formula (1a)

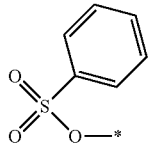

Formula (1b)

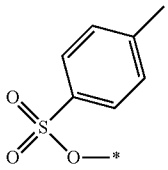

-continued

Formula (1c)

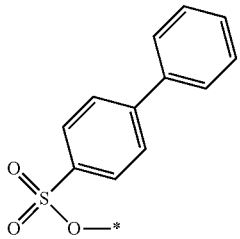

Formula (1d)

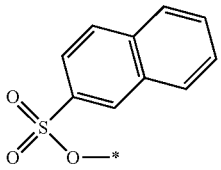

Formula (1e)

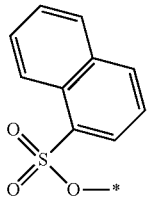

Formula (2a)

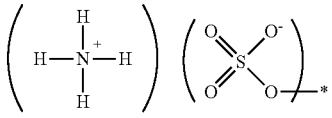

Formula (2b)

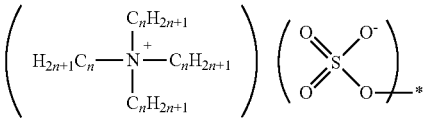

Formula (3a)

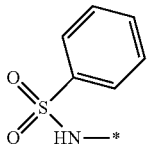

Formula (3b)

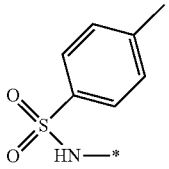

Formula (3c)

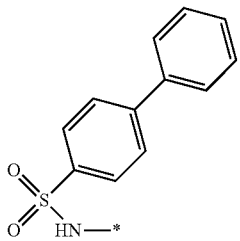

-continued

Formula (3d)

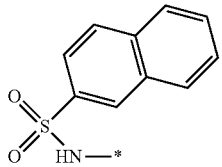

Formula (3e)

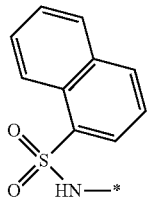

Formula (4a)

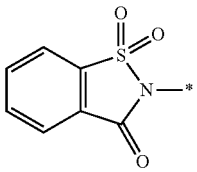

Formula (4b)

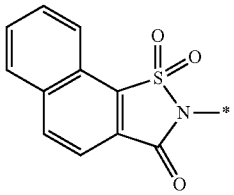

Formula (4c)

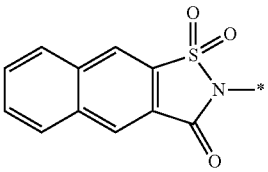

Formula (4d)

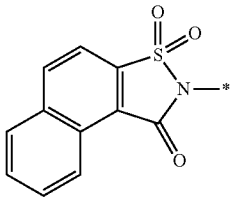

In Formulae (1a) to (1e), (2a) and (2b), (3a) to (3e), and (4a) to (4d), a symbol "*" represents a site of bonding to the metal atom in the polymetalloxane; and n in Formula (2b) represents an integer of 1 or more and 4 or less.

[Support]

The support 1 needs to have sufficient rigidity for contacting with the photosensitive member, and can be formed of a metal material. Specifically, examples of the metal material include iron, copper, stainless steel, aluminum, aluminum alloys and nickel. A support formed of a resin reinforced with a filler can be used.

[Elastic Layer]

An elastic material conventionally used for the elastic layer of the charging member, such as rubber or a thermoplastic elastomer, can be used singly or in combination as a material of the elastic layer 2.

Specifically, examples of the rubber include urethane rubber, silicone rubber, butadiene rubber, isoprene rubber, chloroprene rubber, styrene-butadiene rubber, ethylene-propylene rubber, polynorbornene rubber, acrylonitrile rubber, epichlorohydrin rubber and alkyl ether rubber. Examples of the thermoplastic elastomer include styrene elastomers and olefin elastomers.

The elastic layer 2 can contain an electro-conductive agent to have a predetermined electro-conductivity. The suitable range of an electric resistance of the elastic layer 2 is $1.0\times10^{2}\Omega$ more and $1.0\times10^{8}\Omega$ or less.

Examples of the electro-conductive agent which can be used in the electro-conductive elastic layer include carbon-based materials, metal oxides, metals, cationic surfactants, anionic surfactants, amphoteric surfactants, charge preventing agents and electrolytes.

Specifically, examples of the carbon-based materials include electro-conductive carbon black and graphite. Specifically, examples of the metal oxides include tin oxide, titanium oxide and zinc oxide. Specifically, examples of the metals include nickel, copper, silver and germanium.

Specifically, examples of the cationic surfactants include quaternary ammonium salts (lauryltrimethylammonium, stearyltrimethylammonium, octadodecyltrimethylammonium, dodecyltrimethylammonium, hexadecyltrimethylammonium and modified fatty acids-dimethylethylammonium), perchlorates, chlorates, fluoborates, ethosulfates and halogenated benzyl salts (benzyl bromide salts and benzyl chloride salts).

Specifically, examples of the anionic surfactants include aliphatic sulfonates, higher alcohol sulfate ester salts, higher alcohol ethylene oxide adducted sulfate ester salts, higher alcohol phosphate ester salts and higher alcohol ethylene oxide adducted phosphate ester salts.

Examples of the charge preventing agents include nonionic charge preventing agents such as higher alcohol ethylene oxides, polyethylene glycol fatty acid esters and polyhydric alcohol fatty acid esters.

Examples of the electrolytes include salts of metals of Group I (Li, Na, K) in the periodic table (quaternary ammonium salts). Specifically, examples of the salts of metals of Group I in the periodic table include $LiCF_3SO_3$, $NaClO_4$, $LiAsF_6$, $LiBF_4$, NaSCN, KSCN and NaCl.

A salt of a metal of Group II (Ca, Ba) in the periodic table ($Ca(ClO_4)_2$) or a charge preventing agents derived therefrom can also be used as the electro-conductive agent for an electro-conductive elastic layer. Ion-conductive type electro-conductive agents such as complexes of these salts and polyhydric alcohols (1,4-butanediol, ethylene glycol, polyethylene glycol, propylene glycol, polyethylene glycol) or derivatives thereof, or complexes of these salts and monools (ethylene glycol monomethyl ether, ethylene glycol monoethyl ether) can be used.

The elastic layer 2 can have an MD-1 hardness of 60° or more and 85° or less to prevent deformation of the charging member brought into contact with the photosensitive member to be charged. The elastic layer 2 can have a crown shape, namely, have a thickness of the central portion larger than those of ends of the layer in the longitudinal direction to bring the charging member into uniform contact with the photosensitive member in the transverse direction.

[Formation of Surface Layer]

The surface layer 3 is formed as follows: a coating liquid is applied onto the support 1 or the elastic layer 2, and the coating is dried.

The coating liquid can be prepared through mixing of a metal alkoxide with at least one compound selected from compounds represented by Formulae (5) to (8) in an organic solvent:

Formula (5)

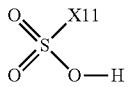

Formula (6)

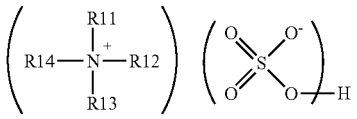

Formula (7)

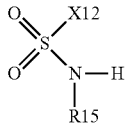

Formula (8)

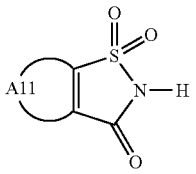

where X11 and X12 are the same as X1 and X2 above, respectively; R11 to R15 are the same as R1 to R5 above, respectively; and A11 is the same as A1 above.

A metal alkoxide used is an alkoxide of aluminum, titanium, zirconium or tantalum. Examples of the alkoxide include methoxide, ethoxide, n-propoxide, iso-propoxide, n-butoxide, 2-butoxide and t-butoxide.

Metal alkoxides used may be metal alkoxides having an alkoxy group partially replaced with β-diketones such as acetylacetone or β-ketoesters such as methyl acetoacetate and ethyl acetoacetate. Alternatively, a plurality of metal alkoxides may be used in combination.

The compound represented by at least one structure selected from those represented by Formulae (5) to (8) can be added in an amount of 0.1 mol or more and 3 mol or less relative to 1 mol of the metal alkoxide. If the compound represented by at least one structure selected from those represented by Formulae (5) to (8) is added in an amount of 0.1 mol or more, adhesion of the toner and/or the external additive of the toner to the surface of the charging member is effectively prevented. If the compound represented by at least one structure selected from those represented by Formulae (5) to (8) is added in an amount of 3 mol or less, the coating liquid has excellent film forming properties. To further enhance the effect of preventing adhesion of the toner and/or the external additive of the toner to the surface of the charging member, the compound represented by at least one structure selected from those represented by Formulae (5) to (8) can be added in an amount of 1 mol or more and 3 mol or less relative to 1 mol of the metal alkoxide.

It is generally known that water, an acid or an alkali or the like is added as a catalyst to promote the reaction to condense metal alkoxide into polymetalloxane. If excess water is present in the reaction system, a condensation reaction between the metal alkoxides occurs preferentially rather than the reaction between the compound represented by at least one structure selected from those represented by Formulae (5) to (8) and a metal alkoxide. Accordingly, the former reaction is unlikely to be proceeded. For this reason, addition of water as a catalyst to the reaction system is not preferred in the present invention. A small amount of water contained in the compound represented by at least one structure selected from those represented by Formulae (5) to (8) as crystal water, however, does not significantly affect the former reaction.

The sulfonic acid represented by Formula (5) may also be used as a catalyst for promoting condensation of the metal alkoxide. In this case, however, the present inventors infer that no bond between the group represented by Formula (1) and the polymetalloxane is formed. In addition of the sulfonic acid represented by Formula (5) as a catalyst in the reaction system, the sulfonic acid is typically used in combination with excess water. Such excess water preferentially causes the condensation reaction between the metal alkoxides as in the case described above, and the sulfonic acid represented by Formula (5) is unlikely to react with the metal alkoxide.

Alternatively, the condensation may be promoted through heating of the coating liquid.

Alkoxysilane can also be added to the coating liquid to further enhance the film properties (smoothness and strength of the film) of the surface layer 3. Examples of usable alkoxysilanes include tetraalkoxysilane, trialkoxysilane and dialkoxysilane.

Specifically, examples of the tetraalkoxysilane include tetramethoxysilane, tetraethoxysilane, tetra(n-propoxy)silane, tetra(iso-propoxy)silane, tetra(n-butoxy)silane, tetra(2-butoxy)silane and tetra(t-butoxy)silane.

Examples of the trialkoxysilane include trimethoxysilanes such as trimethoxyhydrosilane, trimethoxymethylsilane, trimethoxyethylsilane, trimethoxy(n-propyl)silane, trimethoxy(iso-propoxy)silane, trimethoxy(n-butoxy)silane, trimethoxy(2-butoxy)silane, trimethoxy(t-butoxy)silane, trimethoxy(n-hexyl)silane, trimethoxy(n-octyl)silane, trimethoxy(n-decyl)silane, trimethoxy(n-dodecyl)silane, trimethoxy(n-tetradecyl)silane, trimethoxy(n-pentadecyl)silane, trimethoxy(n-hexadecyl)silane, trimethoxy(n-octadecyl)silane, trimethoxycyclohexylsilane, trimethoxyphenylsilane and trimethoxy(3-glycidylpropyl)silane; and triethoxysilanes such as triethoxyhydrosilane, triethoxymethylsilane, triethoxyethylsilane, triethoxy(n-propyl)silane, triethoxy(iso-propoxy)silane, triethoxy(n-butoxy)silane, triethoxy(2-butoxy)silane, triethoxy(t-butoxy)silane, triethoxy(n-hexyl)silane, triethoxy(n-octyl)silane, triethoxy(n-decyl)silane, triethoxy(n-dodecyl)silane, triethoxy(n-tetradecyl)silane, triethoxy(n-pentadecyl)silane, triethoxy(n-hexadecyl)silane, triethoxy(n-octadecyl)silane, triethoxycyclohexylsilane, triethoxyphenylsilane and triethoxy(3-glycidylpropyl)silane.

Specifically, examples of the dialkoxysilane include dimethoxysilanes such as dimethoxydimethylsilane, dimethoxydiethylsilane, dimethoxymethylphenylsilane, dimethoxydiphenylsilane and dimethoxy(bis-3-glycidylpropyl)silane; and diethoxysilanes such as diethoxydimethylsilane, diethoxydiethylsilane, diethoxymethylphenylsilane, diethoxydiphenylsilane and diethoxy(bis-3-glycidylpropyl)silane.

Any organic solvent which can dissolve the metal alkoxide and the compound described above can be used; for example, alcohol solvents, ether solvents, cellosolve solvents, ketone solvents and ester solvents are used.

Specifically, examples of the alcohol solvents include methanol, ethanol, n-propanol, isopropyl alcohol, 1-butanol, 2-butanol, t-butyl alcohol, 1-pentanol and cyclohexanol.

Specifically, examples of the ether solvents include dimethoxyethane. Specifically, examples of the cellosolve solvents include methyl cellosolve and ethyl cellosolve. Specifically, examples of the ketone solvents include acetone, methyl ethyl ketone and methyl iso-butyl ketone.

Specifically, examples of the ester solvents include methyl acetate and ethyl acetate.

The above-described organic solvents can be used singly or in the form of a mixture thereof.

The surface layer 3 can be formed by any method, and a method generally used can be selected. Specifically, examples thereof include coating with a roll coater, immersion coating, and ring coating.

After formation of the surface layer 3, the surface layer 3 can be subjected to a heat treatment to dry the solvent.

The surface treatment of the surface layer 3 can control the surface physical properties such as kinetic friction and surface free energy. Specific examples thereof include a method of irradiating the surface of the surface layer 3 after formation with active energy beams. Examples of active energy beams to be used include ultraviolet light, infrared radiations and electron beams.

The surface layer 3 has a thickness of preferably 0.005 μm or more and 30 μm or less, more preferably 0.005 μm or more and 5 μm or less. The thickness of the surface layer 3 can be controlled through adjustment of the concentration of the solid content in the coating liquid. The concentration of the solid content in the coating liquid can be about 0.01% by mass or more and 20% by mass or less.

<Electrophotographic Apparatus and Process Cartridge>

Figure 2:
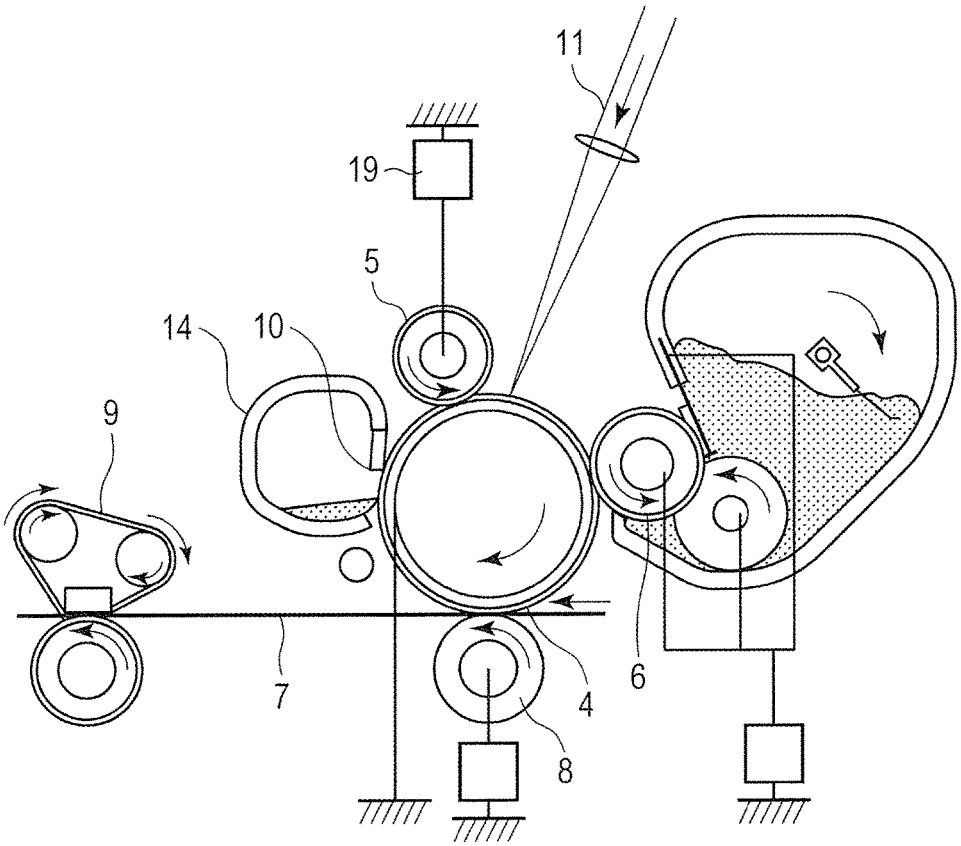
FIG. 2 is a schematic view of an example of the electrophotographic apparatus according to the present disclosure.
Figure 3:
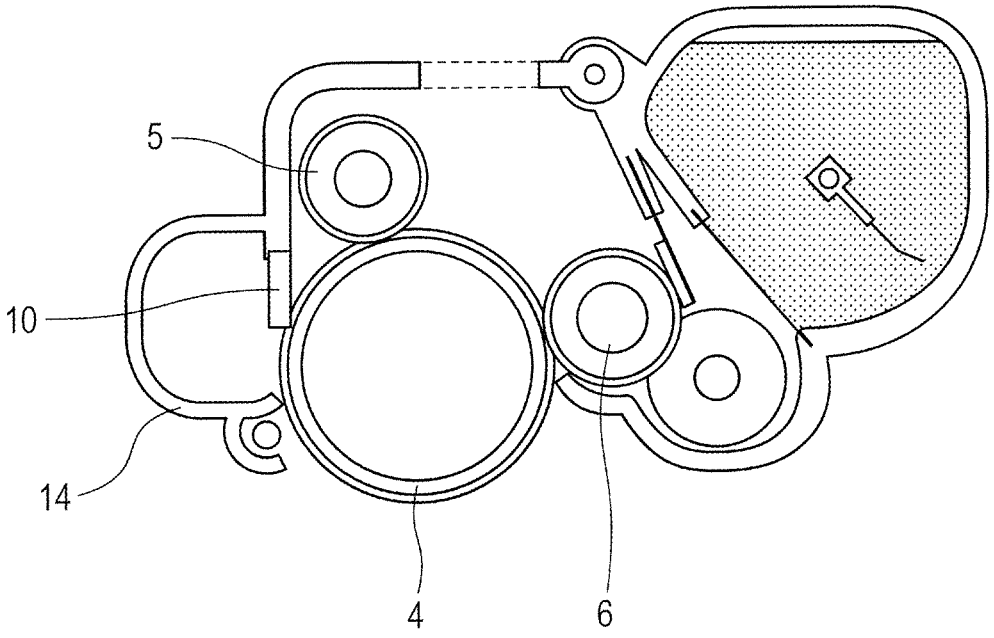
FIG. 3 is a schematic view of an example of the process cartridge according to the present disclosure.

An example of an electrophotographic apparatus including the charging member according to the present invention is illustrated in FIG. 2, and an example of a process cartridge including the charging member according to the present invention is illustrated in FIG. 3.

A photosensitive member 4 is an image bearing member in the form of a rotary drum. The photosensitive member 4 rotates clockwise indicated by the arrow in the diagram, and is driven at a predetermined circumferential speed.

A charging member 5 in the form of a roller (hereinafter, also referred to as "charging roller") is in contact with the surface of the photosensitive member 4 under a predetermined pressure. The charging roller 5 is driven to rotate in the forward direction of the rotation of the photosensitive member 4. A predetermined DC voltage is applied to the charging roller 5 from a charge bias applying power supply 19 (DC charging method). In Examples described later, the DC voltage applied to the charging roller was −1050 V. In such a configuration, the surface of the photosensitive member 4 is uniformly charged to a predetermined polarity potential. In the Examples described later, the dark portion potential was −500 V.

The charged surface of the photosensitive member 4 is irradiated with image exposing light 11 emitted from an exposing device (not illustrated) corresponding to the information on the target image. As a result, the bright portion potential of the photosensitive member is selectively reduced (decayed) to form an electrostatic latent image on the photosensitive member 4. In the Examples described later, the bright portion potential of the photosensitive member was −150 V. A known exposing device such as a laser beam scanner can be used as the exposing device which is not illustrated.

A developing roller 6 selectively applies a toner (negatively chargeable toner) charged to have the same polarity as that of the photosensitive member 4 onto the exposure bright portions of the electrostatic latent image on the surface of the photosensitive member 4 to visualize the electrostatic latent image as a toner image. In the Examples described later, the developing bias was −400 V. Any developing method can be used, for example, a jumping developing method, a contact developing method and a magnetic brush method. The contact developing method can be used particularly in electrophotographic apparatuses outputting color images because scattering of toners can be effectively prevented.

A transfer roller 8 is in contact with the photosensitive member 4 under a predetermined pressure, and rotates in the forward direction of the rotation of the photosensitive member 4 at substantially the same circumferential speed as the circumferential speed of the rotation of the photosensitive member 4. A transfer voltage having a polarity opposite to that of the charge of the toner is applied from a transfer bias applying power supply. A transfer medium 7 is fed to the contact portion between the photosensitive member 4 and the transfer roller 8 from a sheet feeding mechanism (not illustrated) at a predetermined timing. The rear surface of the transfer medium 7 is charged at a polarity opposite to the polarity of the charge of the toner by the transfer roller 8 to which the transfer voltage is applied. The toner image on the surface of the photosensitive member is electrostatically transferred onto the surface of the transfer medium 7 in the contact portion between the photosensitive member 4 and the transfer roller 8. Any known unit can be used as the transfer roller 8. Specifically, examples thereof include transfer rollers including electro-conductive supports made of metals and coated with elastic layers having adjusted middle resistance.

The transfer medium 7 having the transferred toner image is separated from the surface of the photosensitive member, and is introduced into a fixing device 9. The toner image is fixed, and the transfer medium 7 is output as an image formed product. In a double-sided image forming mode or a multiplex image forming mode, this image formed product is introduced into a recirculating transport mechanism (not illustrated) to be reintroduced into a transfer portion. The residues on the photosensitive member 4, such as transfer residual toner or the like, are recovered from the photosensitive member 4 by a cleaning device 14 having a cleaning blade 10. If the photosensitive member 4 has the residual charge, the residual charge of the photosensitive member 4 should be removed by a pre-exposing device (not illustrated) after transfer and before primary charge by the charging roller 5.

The process cartridge according to one aspect of the present invention is configured to be detachably attachable to the main body of an electrophotographic apparatus and integrally supports a charging member and a photosensitive member. A process cartridge integrally supporting the charging roller 5, the photosensitive member 4, the developing roller 6, and the cleaning device 14 having the cleaning blade 10 was used in the Examples described later.

One aspect according to the present invention can provide a charging member which can prevent adhesion of the toner and/or the external additive of the toner to the surface of the charging member, and exhibits stable charging performance during long-term use.

Another aspect according to the present invention can provide a process cartridge and an electrophotographic apparatus which can stably form electrophotographic images with high quality.

EXAMPLES

Hereinafter, the present invention will be described in more detail by way of specific Examples. In the description of the compounds in the Examples, "parts" indicates "parts by mass" unless otherwise specified. A list of reagents used below is shown in Table 1.

TABLE 1

| Symbol | Name of compound | CAS No. | Manufacturer | Notes |
|---|---|---|---|---|
| SL101 | Ethanol | 64-17-5 | KISHIDA CHEMICAL Co., Ltd. | Special grade |
| MA101 | Titanium isopropoxide $Ti(Oi\text{-}Pr)_4$ | 546-68-9 | KISHIDA CHEMICAL Co., Ltd. | |
| MA102 | Aluminum sec-butoxide $Al(OsecBu)_3$ | 2269-22-9 | KISHIDA CHEMICAL Co., Ltd. | |
| MA103 | Zirconium(IV) propoxide $Zr(OnPr)_4$ | 23519-77-9 | KISHIDA CHEMICAL Co., Ltd. | 70 wt % n-propanol solution |
| MA104 | Tantalum(V) tetraethoxide (2,4-pentanedionate) $Ta(OEt)_4(acac)$ | 20219-33-4 | Gelest, inc. | |
| AD101 | Acetylacetone | 123-54-6 | Tokyo Chemical Industry Co., Ltd. | |
| OG101 | p-Toluene sulfonate•monohydrate | 6192-52-5 | Tokyo Chemical Industry Co., Ltd. | |
| OG102 | 2-Naphthalene sulfonic acid hydrate | 76530-12-6 | Tokyo Chemical Industry Co., Ltd. | |
| OG103 | Tetramethylammonium hydrogen sulfate | 80526-82-5 | Tokyo Chemical Industry Co., Ltd. | |
| OG104 | Saccharin | 81-07-2 | Tokyo Chemical Industry Co, Ltd. | |
| OG105 | Ammonium hydrogensulfate | 7803-63-6 | KISHIDA CHEMICAL Co., Ltd. | |

[Preparation of Electro-Conductive Elastic Roller No. 1]

The materials shown in Table 2 were mixed in a 6 L pressurized kneader (trade name: TD6-15NDX, manufactured by Toshin Co., Ltd.) at a filling rate of 70% by volume and a number of rotation of the blade of 30 rpm for 24 minutes to prepare an unvulcanized rubber composition. Tetrabenzylthiuram disulfide [trade name: Sanceler TBzTD, manufactured by Sanshin Chemical Industry Co., Ltd.] (4.5 parts) as a vulcanization accelerator and sulfur (1.2 parts) as a vulcanizing agent were added to the unvulcanized rubber composition (174 parts by mass).

These materials were horizontally turned 20 times in total with open rolls each having a roll diameter of 12 inches at a number of rotations of the forward roll of 8 rpm, a number of rotations of the back roll of 10 rpm, and an interval of the rolls of 2 mm. Subsequently, tight milling was performed 10 times at an interval of the rolls of 0.5 mm to prepare "Kneaded product No.1" for an electro-conductive elastic layer.

TABLE 2

| Raw materials | Amount used (parts by mass) |
|---|---|
| Medium-high nitrile NBR (Trade name: Nipol DN219, manufactured by ZEON Corporation) | 100 |
| Coloring grade carbon black (Trade name: #7360, manufactured by Tokai Carbon Co., Ltd.) | 48 |
| Calcium carbonate (Trade name: NANOX #30, manufactured by Maruo Calcium Co., Ltd.) | 20 |
| Zinc oxide (Trade name: zinc oxides No. 2(JIS); manufactured by Sakai Chemical Industry Co., Ltd.) | 5 |
| Stearic acid (Trade name: Zinc stearate: manufactured by NOF CORPORATION) | 1 |

Next, a cylindrical support made of steel and having a diameter of 6 mm and a length of 252 mm (having a nickel-plated surface; hereinafter, referred to as "mandrel") was provided. A thermosetting adhesive containing a metal and rubber (trade name: METALOC U-20, manufactured by Toyokagaku Kenkyusho Co., Ltd.) was applied onto a region of the mandrel in width of 115.5 mm ranging from the center in the axis direction toward each end of the mandrel (the region having a total width of 231 mm in the axis direction). This mandrel was dried at a temperature of 80° C. for 30 minutes, and further at 120° C. for 1 hour.

By extrusion molding using a crosshead, Kneaded product No. 1 was simultaneously extruded coaxially with the mandrel having the adhesive layer into a cylindrical shape having an outer diameter of 8.75 to 8.90 mm, and both ends were cut off to dispose the unvulcanized electro-conductive elastic layer on the outer periphery of the mandrel. The extruder used had a cylinder diameter of 70 mm and L/D=20. The temperatures of the head, the cylinder and the screw during extrusion were adjusted to 90° C.

Next, the roller was vulcanized in a continuous heating furnace provided with two zones having different temperatures. The roller was passed through the first zone set at a temperature of 80° C. in 30 minutes, and was passed through the second zone set at a temperature of 160° C. in 30 minutes to prepare Electro-conductive elastic roller.

Next, both ends of the electro-conductive elastic layer portion (rubber portion) of Electro-conductive elastic roller were cut off to prepare an electro-conductive elastic layer having a width in the axis direction of 232 mm. Subsequently, the surface of the electro-conductive elastic layer was polished with a rotary grinding wheel (the number of rotations of the work: 333 rpm, the number of rotations of the grinding wheel: 2080 rpm, polishing time: 12 sec). Electro-conductive elastic roller No. 1 was thereby prepared. Electro-conductive elastic roller No. 1 had a crown shape having an end diameter of 8.26 mm and a central diameter of 8.50 mm, a surface ten-point height of irregularities Rz of 5.5 μm, a runout of 18 μm, and a hardness of 73° (Asker C).

The ten-point height of irregularities Rz was determined according to JIS B 0601:2013. The runout was determined with a high precision laser analyzer (trade name: LSM 430v, manufactured by Mitutoyo Corporation). Specifically, the outer diameter of the roller was measured with the analyzer to determine an outer diameter difference runout from the difference between the largest outer diameter and the smallest outer diameter. Five points of the roller were subjected to this measurement. The average of the five outer diameter difference runouts was defined as the runout of the target roller. The Asker C hardness was measured as follows: a probe of Asker Type C Durometer (manufactured by Kobunshi Keiki Co., Ltd.) was brought into contact with the surface of the target roller in a condition of weight load of 1000 g under an environment at 25° C. and 55% RH.

[Preparation of Coating Liquid]

Examples

Preparation of Coating Liquids E1 to E9 p-Toluene sulfonate (0.46 g) and ethanol (97.3 g) were weighed, and were then placed in a glass container. These materials were dissolved with stirring. A solution (2.29 g) of 70 wt % zirconium propoxide in propanol was added thereto, and was stirred to prepare coating liquid E1.

Coating liquids E2 to E9 were prepared by the same method as in coating liquid E1 except that the materials and the amounts thereof were varied as shown in Table 3 below.

TABLE 3

| | Metal alkoxide | | Organic component | | Solvent | |
|---|---|---|---|---|---|---|
| Coating liquid No. | Symbol for compound in Table 1 | Parts | Symbol for compound in Table 1 | Parts | Symbol for compound in Table 1 | Parts |
| E1 | MA103 | 2.29 g | OG101 | 0.46 g | SL101 | 97.3 g |
| E2 | MA103 | 1.63 g | OG101 | 0.66 g | SL101 | 97.7 g |
| E3 | MA103 | 1.45 g | OG102 | 0.65 g | SL101 | 97.9 g |
| E4 | MA103 | 2.65 g | OG103 | 0.32 g | SL101 | 97.0 g |
| E5 | MA103 | 2.59 g | OG104 | 0.33 g | SL101 | 97.1 g |
| E6 | MA101 | 1.02 g | OG102 | 0.75 g | SL101 | 98.2 g |
| E7 | MA102 | 1.15 g | OG101 | 0.89 g | SL101 | 98.0 g |
| E8 | MA102 | 1.57 g | OG105 | 0.73 g | SL101 | 97.7 g |
| E9 | MA104 | 1.34 g | OG101 | 0.50 g | SL101 | 98.2 g |

Comparative Examples

Preparation of Coating Liquids C1 to C5

Ethanol (96.2 g) was weighed, and was then placed in a glass container. A solution (3.80 g) of 70 wt % zirconium propoxide in propanol was added, and was stirred to prepare coating liquid C1. Coating liquids C2 and C3 were prepared by the same method as in coating liquid C1 except that the materials and the amounts thereof were varied as shown in Table 4 below.

In coating liquids C1 to C3, however, the solutions became cloudy during preparation, and it was difficult to prepare a charging member. For this reason, the following evaluation of the coating liquid was not performed on coating liquids C1 to C3.

Ethanol (95.4 g) was weighed, and was then placed in a glass container. A solution (3.80 g) of 70 wt % zirconium propoxide in propanol was added, and acetylacetone (0.81 g) was added thereto as an additive. These materials were stirred to prepare coating liquid C4. Coating liquid C5 was prepared by the same method as in coating liquid C4 except that the materials and the amounts thereof were varied as shown in Table 4 below.

TABLE 4

| | Metal alkoxide | | Additives | | Solvent | | |
|---|---|---|---|---|---|---|---|
| Coating liquid No. | Symbol for compound in Table 1 | Parts | Symbol for compound in Table 1 | Parts | Symbol for compound in Table 1 | Parts | Notes |
| Coating liquid C1 | MA103 | 3.80 g | None | — | SL101 | 96.2 g | Immediately became cloudy |
| Coating liquid C2 | MA101 | 3.56 g | None | — | SL101 | 96.4 g | Immediately became cloudy |
| Coating liquid C3 | MA102 | 4.83 g | None | — | SL101 | 96.0 g | Immediately became cloudy |
| Coating liquid C4 | MA103 | 3.80 g | AD101 | 0.81 g | SL101 | 95.4 g | |
| Coating liquid C5 | MA101 | 3.56 g | AD101 | 1.25 g | SL101 | 95.2 g | |

[Preparation of Charging Member]

Electro-conductive elastic roller No. 1 was ring coated with coating liquid E1 at an output rate of 0.120 ml/s (speed of the ring part: 85 mm/s). The roller was left to stand at normal temperature and normal pressure to be dried, and the surface of the coated roller was then irradiated with ultraviolet light at a wavelength of 254 nm at an accumulated amount of light of 9000 mJ/cm$^2$ to form a surface layer. The surface of the roller was irradiated with ultraviolet light from a low pressure mercury lamp [manufactured by TOSHIBA LIGHTING & TECHNOLOGY CORPORATION]. Charging member E1 was thereby prepared.

Charging members E2 to E9 and charging members C4 and C5 were prepared by the same method as in charging member E1 except that coating liquids E2 to E9 and coating liquids C4 and C5 were used.

[Evaluation]

(1) Structural Analysis of Coating

First, zirconium n-butoxide was dissolved in ethanol. A large amount of ion-exchanged water was added to the solution, and was stirred. A solid was then precipitated. The solid was burned at 160° C. for 1 hour to prepare sample A. Coating liquid E2 was burned at 160° C. for 1 hour to prepare sample B.

Next, samples A and B were analyzed with an X-ray photoelectron spectrometer "QUANTUM 2000" (manufactured by ULVAC-PHI, Inc.) by X-ray photoemission spectroscopy (ESCA).

The conditions for measurement are as follows:

Conditions for measurement

X-ray source: Al Kα rays

Figure 4:
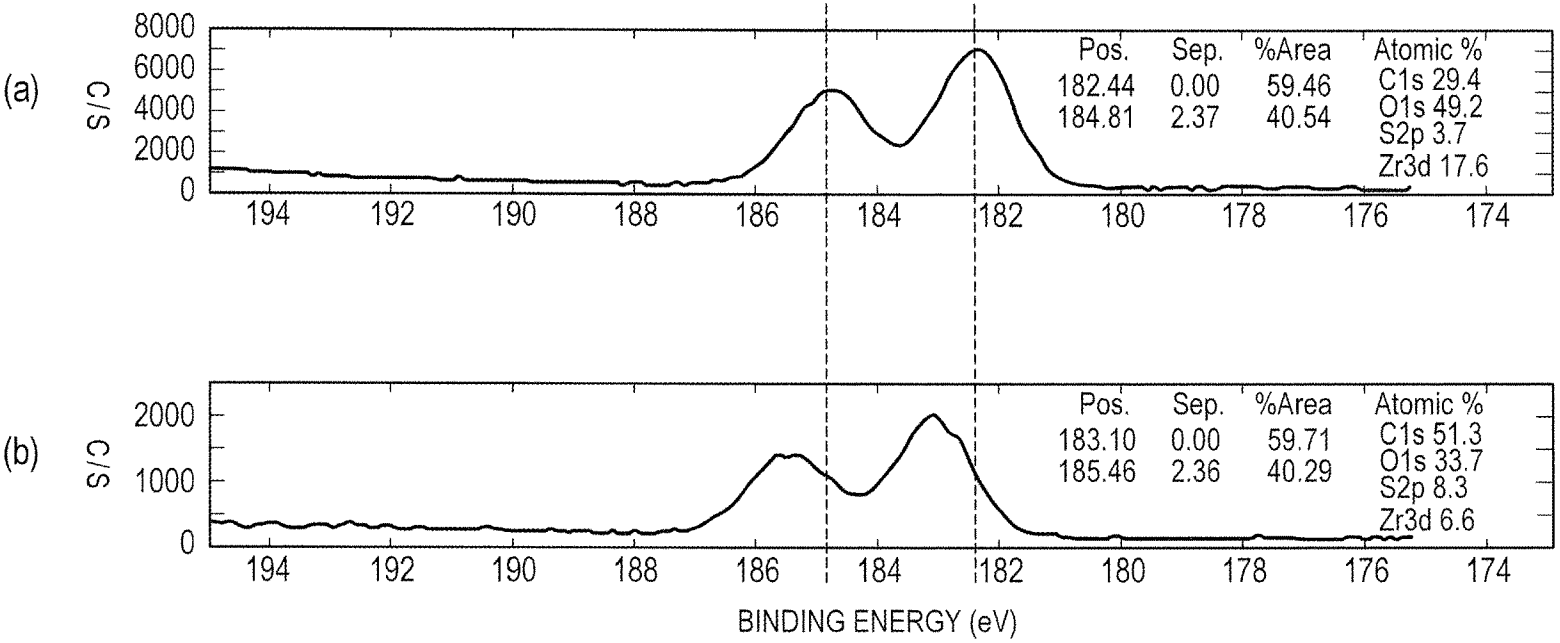
FIG. 4 is an example of results of measurement by X-ray photoemission spectroscopy.

X-ray output: 15 KV, 25 W
Beam diameter: ϕ100 μm
Region for measurement: 300 μm×300 μm
Angle of detection: 45 degrees The results of measurement of sample A are illustrated in FIG. 4(*a*), and the results of measurement of sample B are illustrated in FIG. 4(*b*). It was verified that the peaks derived from the 3d orbital of zirconium are shifted in sample B. This shift suggests that zirconium was bonded to p-toluene sulfonate to alter the electron structure of zirconium.

(2) Evaluation of Amount of Charging of Coating

Coating liquid E1 was applied onto an SUS substrate through spin coating (200 rpm, 30 seconds), and the coating was burned at 120° C. for 30 minutes to prepare sample plate E1 to be used in measurement of the amount of charging. Sample plates E2 to E9 and sample plates C4 and C5 were prepared by the same method as in sample plate E1 except that coating liquids E2 to E9 and coating liquids C4 and C5 were used.

Figure 5:
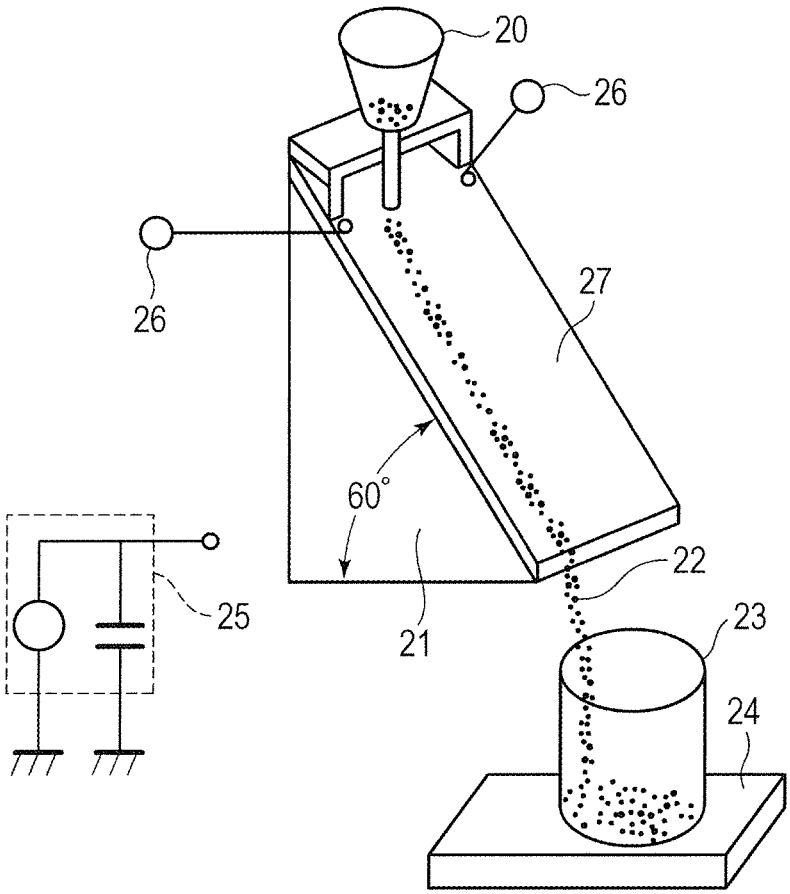
FIG. 5 is a schematic view of an example of a cascade-type surface charging amount measurement apparatus.

The amounts of charging of these sample plates were measured under an N/N (temperature: 22° C., relative humidity: 55%) environment with a cascade-type surface charging amount measurement apparatus (manufactured by KYOCERA Chemical Corporation (formerly Toshiba Chemical Corporation)) illustrated in FIG. 5.

First, the mass W1 [g] of a container 23 was weighed. The container 23 was placed on an insulating plate 24. Next, a sample plate 27 was fixed to an inclined plate 21 having an inclination of 60 degrees. As a reference powder 22, a carrier for an electrophotographic developer including a core material containing ferrite (trade name: "MF-60," manufactured by Powdertech Co., Ltd.) was dropped from a reference powder inlet 20 for 20 seconds. The powder "MF-60" contains manganese and iron, and has a surface not coated with a resin. The saturation magnetization is 90 to 97 $Am^2/kg$, the average particle diameter is 60 μm, and the apparent density is 2.4 to 2.7 $g/cm^3$.

After dropping of the reference powder, the total amount of charging Q [μC] of the sample plate 27 was measured with an electrometer 25 connected to a meter connection terminal 26. The total mass W2 [g] of the container 23 after dropping of the reference powder was weighed. The amount of charging Q/W was calculated from the following expression:

$$\text{amount of charging } Q/W\ [\mu C/g] = Q/(W2-W1)$$

A higher amount of charging Q/W of the surface of a charging member indicates that a negatively chargeable toner can be more readily negatively charged through friction with the charging member. Accordingly, this leads to a conclusion that a higher amount of charging Q/W measured by the method above indicates a higher effect of preventing electrostatic adhesion of a weakly negatively charged toner or a positively charged toner to the charging member in the charging member including a surface layer formed of the coating liquid prepared.

The results of evaluation are collectively shown in Table 4.

(3) Evaluation of Contamination of Charging Member

A cyan cartridge for a printer "HP Color LaserJet CP 4525" manufactured by Hewlett-Packard Company was provided. The charging member set in the cartridge was replaced with charging member E1 prepared above. This cartridge was mounted on the printer "HP Color LaserJet CP 4525" manufactured by Hewlett-Packard Company, and a halftone image was output on 12000 sheets under an environment at low temperature and low humidity (10° C., 15% RH).

Subsequently, charging member E1 was took out from the cartridge, and then the surface of charging member E1 was visually observed. The observation result was evaluated by the following criteria.

Rank "A": almost no contamination is found, or contaminations are slightly found.

Rank "C": a lot of contaminations are found in the surface.

Charging members E2 to E9 and charging members C4 and C5 were evaluated for contamination in the same manner as above. The results are shown in Table 5 below.

TABLE 5

| | Charging member | Coating liquid | Amount of charging (μC/g) | Evaluation rank on contamination |
|---|---|---|---|---|
| Example 1 | Charging member E1 | Coating liquid E1 | 0.0042 | A |
| Example 2 | Charging member E2 | Coating liquid E2 | 0.0053 | A |
| Example 3 | Charging member E3 | Coating liquid E3 | 0.0027 | A |
| Example 4 | Charging member E4 | Coating liquid E4 | 0.0005 | A |
| Example 5 | Charging member E5 | Coating liquid E5 | 0.0024 | A |
| Example 6 | Charging member E6 | Coating liquid E6 | 0.0014 | A |
| Example 7 | Charging member E7 | Coating liquid E7 | 0.0041 | A |
| Example 8 | Charging member E8 | Coating liquid E8 | 0.0004 | A |
| Example 9 | Charging member E9 | Coating liquid E9 | 0.0004 | A |
| Comparative Example 1 | Charging member C4 | Coating liquid C4 | −0.0004 | C |
| Comparative Example 2 | Charging member C5 | Coating liquid C5 | −0.0019 | C |

In sample plates E1 to E9 prepared with coating liquids E1 to E9, the sample plate was positively charged (reference powder was negatively charged). The amount of contamination of the surface of the charging member was small in the charging members prepared with coating liquids E1 to E9.

In contrast, in sample plates C4 and C5 prepared with coating liquids C4 and C5, the sample plate was negatively charged (reference powder was positively charged). The amount of contamination of the surface of the charging member was large in charging members C4 and C5 prepared with coating liquids C4 and C5.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-129031, filed Jun. 26, 2015, which is hereby incorporated by reference herein in its entirety.

What is claimed is:

1. A charging member comprising a support, and a surface layer on the support, wherein the surface layer comprises:

a polymetalloxane containing at least one metal atom selected from the group consisting of aluminum, titanium, zirconium and tantalum, and at least one group selected from groups represented by Formulae (1) to (4) is bonded to the at least one metal atom in the polymetalloxane:

(1)

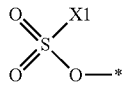

(2)

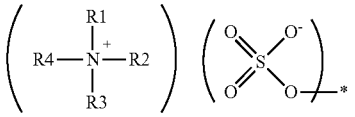

(3)

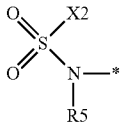

(4)

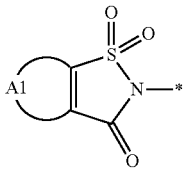

where X1 and X2 each independently represent an alkyl group having 1 to 20 carbon atoms or a substituted or unsubstituted aryl group having 6 to 20 carbon atoms; R1 to R5 each independently represent a hydrogen atom or an alkyl group having 1 to 20 carbon atoms; A1 represents a group of atoms needed to form an aromatic ring; and a symbol "*" represents a site of bonding to the metal atom in the polymetalloxane.

2. The charging member according to claim 1, wherein the at least one group selected from the groups represented by Formulae (1) to (4) is contained in an amount of 0.1 to 3 mol relative to 1 mol of the metal atom in the polymetalloxane.

3. The charging member according to claim 2, wherein the at least one group selected from the groups represented by Formulae (1) to (4) is contained in an amount of 1 to 3 mol relative to 1 mol of the metal atom in the polymetalloxane.

4. The charging member according to claim 1, wherein the group bonded to the metal atom is at least one group selected from groups represented by Formulae (1a) to (1e), (2a) and (2b), (3a) to (3e), and (4a) to (4d):

(1a)

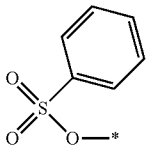

(1b)

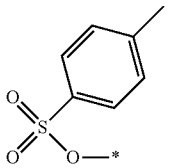

-continued (1c)

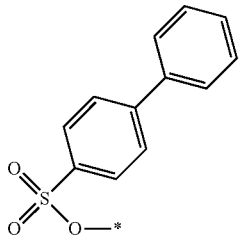

(1d)

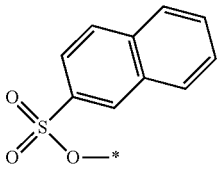

(1e)

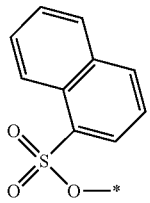

(2a)

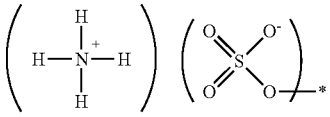

(2b)

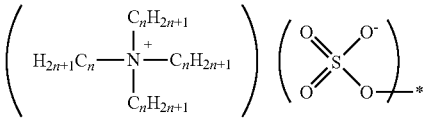

(3a)

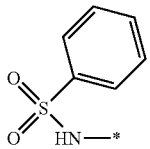

(3b)

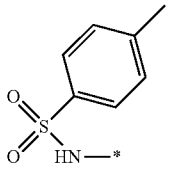

(3c)

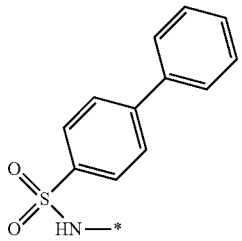

-continued (3d)

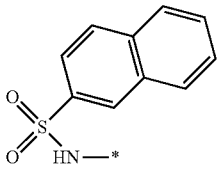

(3e)

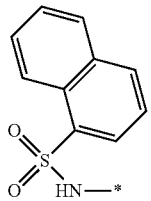

(4a)

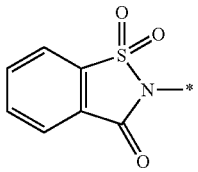

(4b)

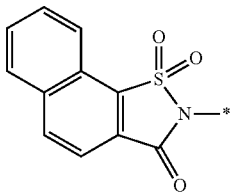

(4c)

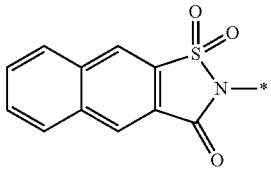

(4d)

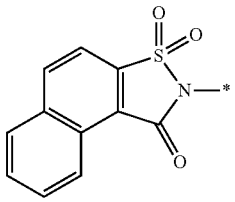

where a symbol "*" represents a site of binding to the metal atom in the polymetalloxane; and n in Formula (2b) represents an integer of 1 to 4.

5. A process cartridge configured to be detachably attachable to a main body of an electrophotographic image forming apparatus, comprising an electrophotographic photosensitive member, and a charging member disposed such that the surface of the electrophotographic photosensitive member can be charged, wherein the charging member comprises a support, and a surface layer on the support, and the surface layer comprises:

a polymetalloxane containing at least one metal atom selected from the group consisting of aluminum, titanium, zirconium and tantalum, and at least one group selected from groups represented by Formulae (1) to (4) is bonded to the at least one metal atom in the polymetalloxane:

(1)

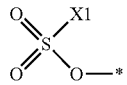

(2)

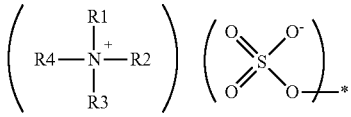

(3)

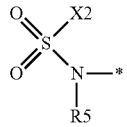

(4)

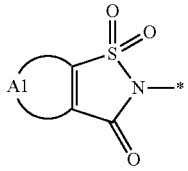

where X1 and X2 each independently represent an alkyl group having 1 to 20 carbon atoms or a substituted or unsubstituted aryl group having 6 to 20 carbon atoms; R1 to R5 each independently represent a hydrogen atom or an alkyl group having 1 to 20 carbon atoms; A1 represents a group of atoms needed to form an aromatic ring; and a symbol "*" represents a site of bonding to the metal atom in the polymetalloxane.

6. An electrophotographic image forming apparatus comprising an electrophotographic photosensitive member, and a charging member disposed such that the surface of the electrophotographic photosensitive member can be charged, wherein the charging member comprises a support, and a surface layer on the support, and the surface layer comprises:

a polymetalloxane containing at least one metal atom selected from the group consisting of aluminum, titanium, zirconium and tantalum, and at least one group selected from groups represented by Formulae (1) to (4) is bonded to the at least one metal atom in the polymetalloxane:

(1)

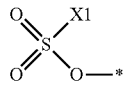

(2)

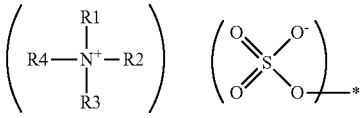

(3)

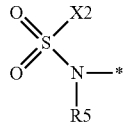

-continued (4)

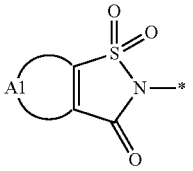

where X1 and X2 each independently represent an alkyl group having 1 to 20 carbon atoms or a substituted or unsubstituted aryl group having 6 to 20 carbon atoms; R1 to R5 each independently represent a hydrogen atom or an alkyl group having 1 to 20 carbon atoms; A1 represents a group of atoms needed to form an aromatic ring; and a symbol "*" represents a site of bonding to the metal atom in the polymetalloxane.

* * * * *